US006785499B1

(12) United States Patent
Tanaka

(10) Patent No.: US 6,785,499 B1
(45) Date of Patent: Aug. 31, 2004

(54) DEVELOPING DEVICE AND IMAGE FORMING APPARATUS

(75) Inventor: Yoshiaki Tanaka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/370,495

(22) Filed: Feb. 24, 2003

(51) Int. Cl.[7] ..... G03G 15/01
(52) U.S. Cl. ..... 399/287; 399/119
(58) Field of Search ..... 399/119, 120, 399/223, 224, 226, 227, 258, 262

(56) References Cited

U.S. PATENT DOCUMENTS 6,137,975 A * 10/2000 Harumoto et al. ..... 399/227

FOREIGN PATENT DOCUMENTS

JP 9-152757 A 6/1997

* cited by examiner

*Primary Examiner*—Hoang Ngo
(74) *Attorney, Agent, or Firm*—Foley & Lardner LLP

(57) ABSTRACT

The developing device of the present invention has developer containers detachably to house developers to be supplied by hollow holding members, supports plural developing units to supply different color developers to an image carrier and plural developing units in the replaceable state, and a revolver to move a desired developing unit to a point opposite to the image carrier by rotating plural developing units en block, and openings of the holding members for inserting the developer containers in the holding members when removed.

11 Claims, 5 Drawing Sheets

DEVELOPING DEVICE AND IMAGE FORMING APPARATUS

BACKGROUND OF THE INVENTION

1. Field of the Invention

The present invention relates to a developing device for forming a color developing image using a revolver type developing device in such image forming apparatus as electro-photographic apparatus, printers, etc.

2. Description of the Related Art

In multi-color image forming apparatus equipped with plural developing units around a photosensitive drum, a multi-color image forming apparatus with a handle provided to each of developing units for removing them in the normal direction of developing sleeves is disclosed in Japanese Patent Publication No. 9-152757. However, this conventional multi-color image forming apparatus lacks a space for individually arranging plural developing units around a photosensitive drum and the downsizing is impeded.

On the other hand, in order to achieve the downsizing, an image forming apparatus having plural developing units, for example, 3 developing units for supplying yellow (Y), magenta (M) and cyan (C) toners installed to a single revolving holder and further, a revolver type developing device to develop images formed on a photosensitive drum by rotating a revolving holder with a developing unit to supply black (BK) toner added by arranging developing units in prescribed color sequentially at an opposite position to a photosensitive drum are developed in recent years. This revolving type developing device is devised to achieve the further downsizing of the main body of an image forming apparatus by providing toner cartridges in the developing units.

In this revolving type developing device, there is no space for installing handles, etc. for removing the developing units from the revolving holder. Therefore, when replacing the developing units during the maintenance, a serviceman removes developing units from a revolving holder by grasping the handle directly, etc. in a method easy to take out the developing unit carefully so as not to contaminate his hand.

However, it is difficult to grasp a developing unit less handle and when removing developing units from a revolving holder, a worker may touch developing rollers and contaminate his hand or a developing unit may be dropped accidentally and damaged and further, the periphery may be contaminated by a developing unit when dropped and the operability may be deteriorated.

Accordingly, it is so far desired to obtain a revolving type developing device that has the superior operability and high reliability by removing developing units from the revolving holder easily and safely without contaminating a hand and impeding the downsizing of the main body of the developing device.

SUMMARY OF THE INVENTION

An object of the present invention is to remove developing units of a revolving type developing device easily and certainly from a revolving holder when replacing them by grasping them without contaminating a hand or dropping them and to improve the operability and reliability during the maintenance work.

According to an embodiment of the present invention, a developing device comprising: plural developing units that have developer containers to house developers to be supplied detachably in a hollow holding member and supply different color developers to an image carrier and a revolver that supports the plural developing units in the replaceable state is provided and this developing device is capable of rotating the plural developing units en block to place a desired developing unit opposite to the image carrier; and is characterized in that the openings are formed on the holding member to insert the developer containers into the holding member when the developer containers are removed.

Further, according to the embodiment of the present invention, an image forming apparatus comprising: an image carrier; a latent image forming unit to form a latent image on the image carrier; plural developing units having developer containers housing supply developers detachably by a hollow shaped holding member and supply developers in different colors to the image carrier; and a revolver provided rotatably in the main body of an apparatus, supports the plural developing units in the replaceable state and rotates the plural developing units en block to bring a desired developing unit to a point opposite to the image carrier, is characterized in that openings are formed on the holding members to insert the developing containers in the holding members when the developer containers are removed.

DETAILED DESCRIPTION OF THE INVENTION

Figure 1:
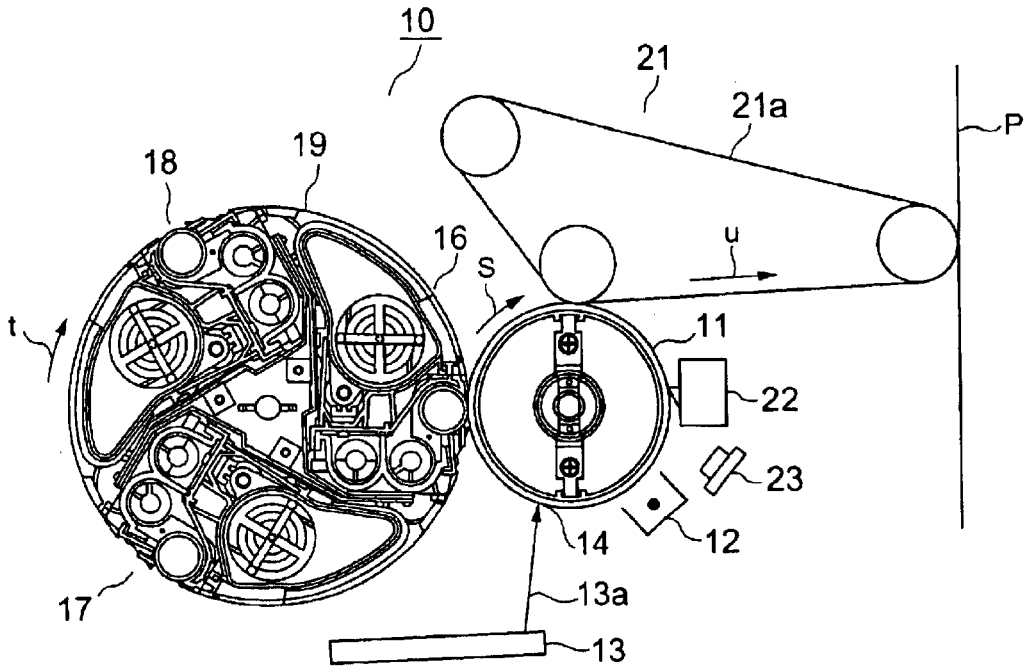
FIG. 1 is a schematic diagram showing an image forming unit of an embodiment of the present invention.

A preferred embodiment of the present invention will be described below in detail referring to the attached drawings. FIG. 1 is a schematic construction diagram showing an image forming unit 10 of an image forming apparatus 8 such as color printers, etc. Around a photosensitive drum 11 that is an image carrier, of the image forming unit 10, there are arranged a charger 12 for uniformly charging the photosensitive drum 11 following the rotation of the photosensitive drum 11 in the arrow direction s, a laser beam applying position 14 to apply a laser beam 13*a* from a laser wiring unit 13 that is a latent image forming unit 13 to form a latent image on the charged photosensitive drum 11, a revolver 19 to support developing units 16, 17, 18 for developing images with yellow (Y), magenta (M) and cyan (C) developers so that they can rotate in the arrow direction t by a rotary holder 1 9*a*, an intermediate transferring unit 21 that has an intermediate transferring belt 21*a* that is rotated in the arrow direction u, a cleaner 22 and a charge elimination lamp 23.

Figure 2:
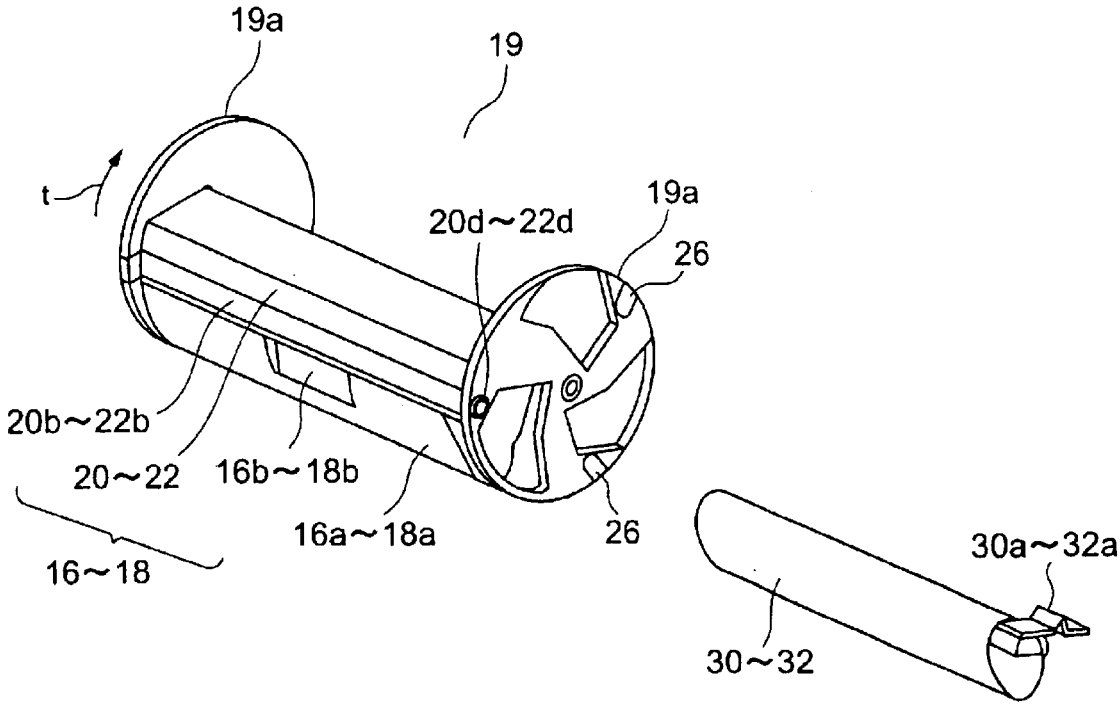
FIG. 2 is a perspective view for explaining the state of a revolver with a toner cartridge removed.
Figure 3:
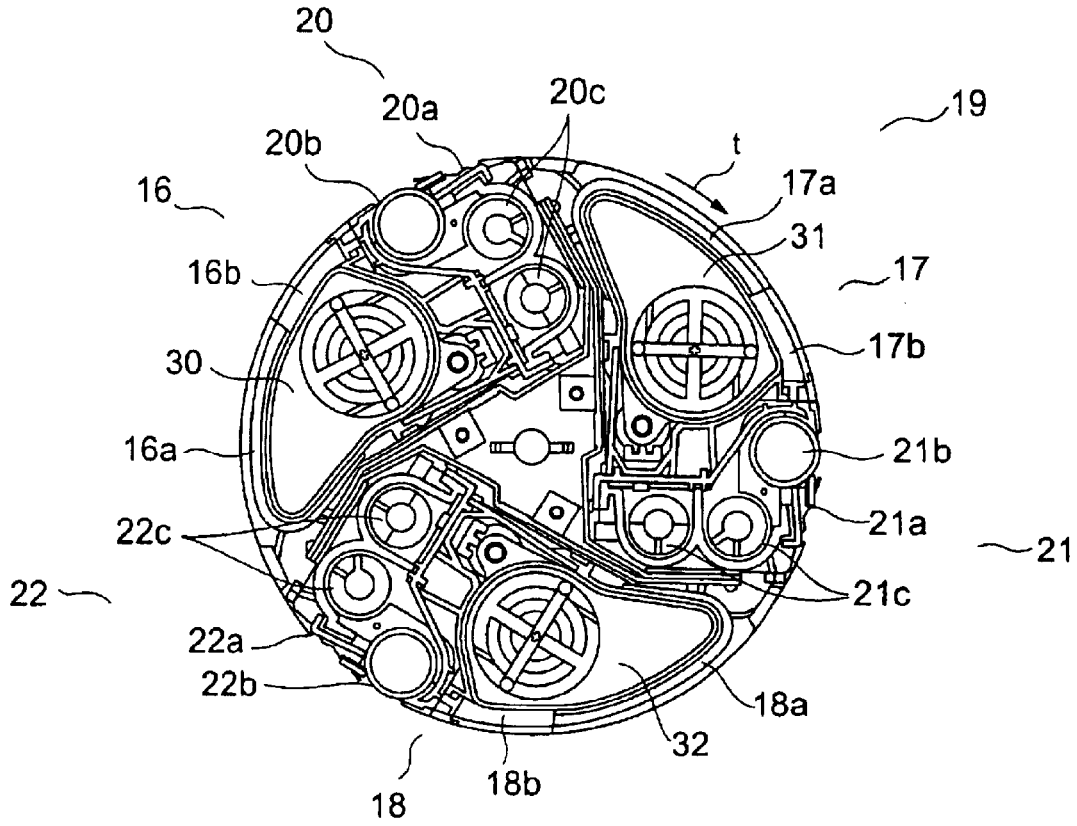
FIG. 3 is an explanatory diagram showing a developing unit supported by a revolver in the embodiment of the present invention.

The laser writing unit 13 forms an electrostatic latent image on the photosensitive drum 11 by applying a laser beam 13*a* corresponding to each color writing signal according to image data that are input from external computer terminals, etc. The revolver 19 supports the developing units 16–18 so that they can be replaced by a rotary holder 19*a* that is rotated in the arrow direction t as shown in FIG. 2. The revolver 19 rotates the yellow (Y), magenta (M) and cyan (C) developing units 16–18 en bloc by rotating the rotary holder 19*a* in the arrow direction and then, moves desired developing units 16–18 to positions opposite to the photosensitive drum 11. The developing units 16–18 are provided with developing devices 20, 21, 22 that have developing rollers 20*b*–22*b* and conveying augers 20*c*–22*c* to supply toners to electrostatic latent images on the photosensitive drum 11 in the developing containers 20*a*–22*a* as shown in FIG. 3.

Figure 4:
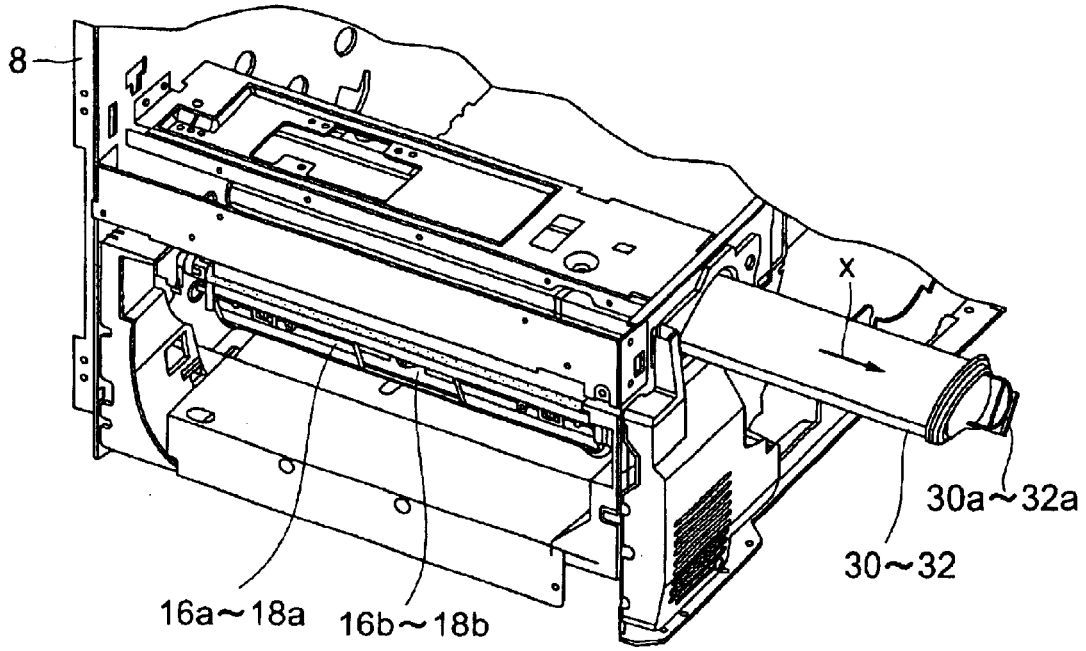
FIG. 4 is a partial perspective view showing the slide movement of a toner cartridge from the main body of a developing unit in the embodiment of the present invention.
Figure 5:
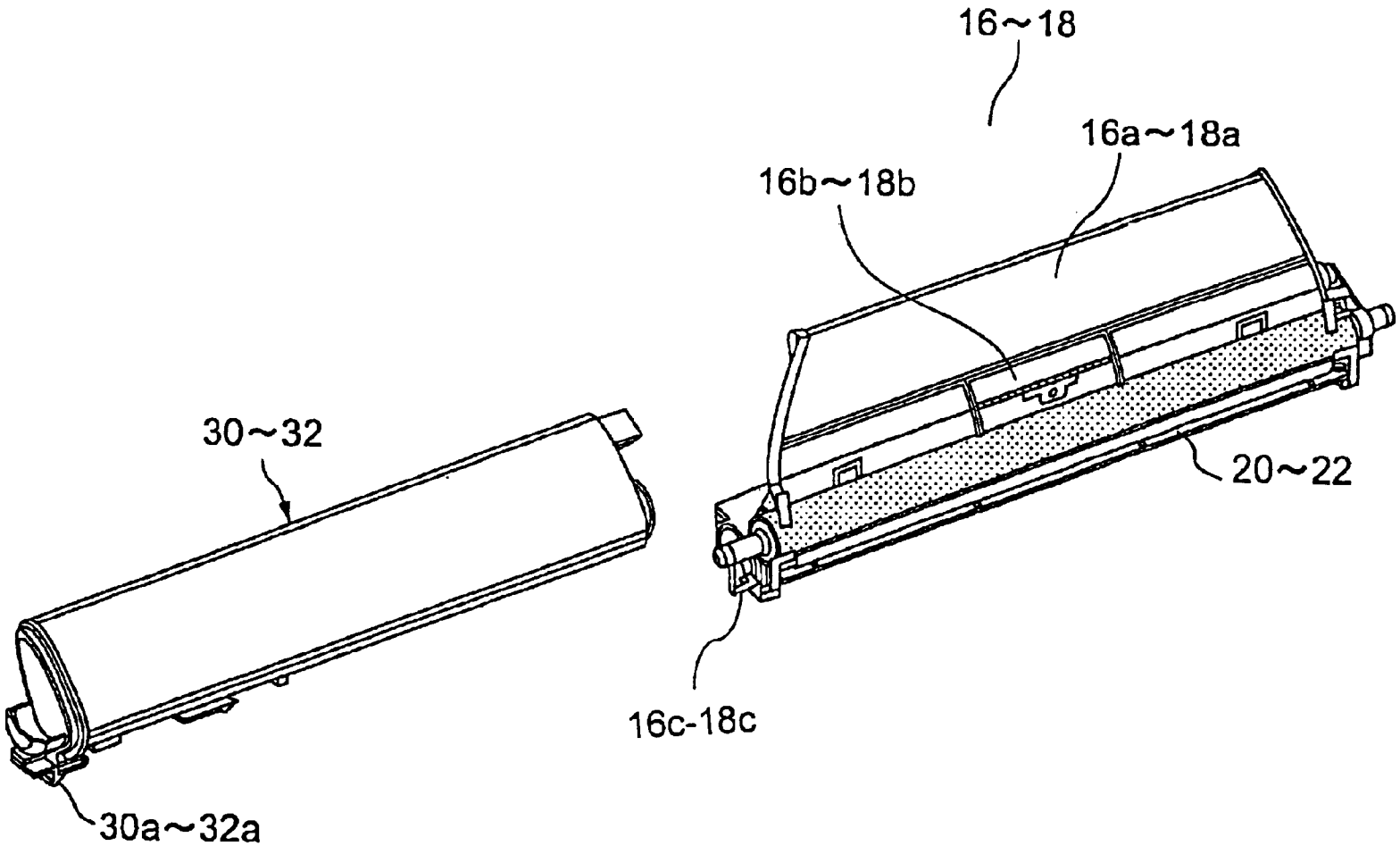
FIG. 5 is a perspective view showing the state of the developing unit with a toner cartridge removed in the embodiment of the present invention.

The developing units 16–18 are further provided with hollow shaped holders 16*a*–18*a*. These holders 16*a*–18*a* retain toner cartridges 30, 31, 32 that are developer containers to house yellow (Y), magenta (M), cyan (C) toners to be supplied to the developing devices 20–22. The toner cartridges 30–32 are fixed to the developing units 16–18 by locking claws 30*a*–32*a* attached to hooks 16*c*–18*c* as shown in FIG. 4 and FIG. 5. The toner cartridges 30–32 are detachable from the holder 16*a*–18*a* by sliding to the front side of the main body 8*a* of the image forming apparatus 8. At about the center of the outer surfaces of the holders 16*a*–18*a*, openings 16*b*–18*b* are formed to communicate with the hollow inside of the holders 16*a*–18*a*.

Figure 6:
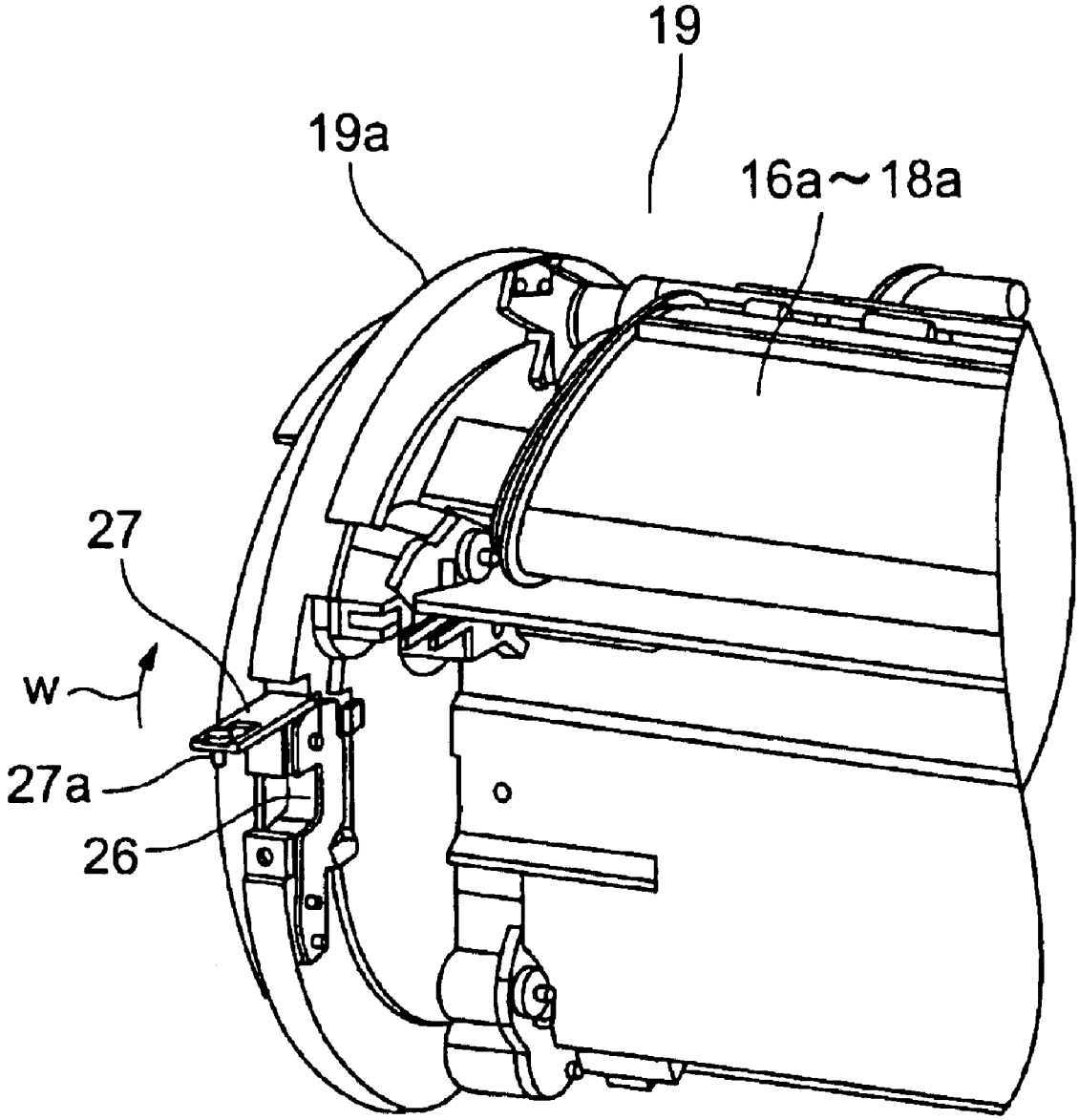
FIG. 6 is a partial perspective view showing the revolver in the state with the developing unit removed in the embodiment of the present invention.

In the revolver 19, both ends of shafts 20*d*–22*d* of developing rollers 20*b*–22*b* are provided at a positioning portion 26 formed on the rotary holder 19*a* via bearings and hold the developing units 16–18 as shown in FIG. 6. At the positioning portion 26, a developing unit fixing member 27 is rotatably mounted. To remove the developing units 16–18 from the revolver 19, open the positioning portion 26 by removing a screw 27*a* and rotating the developing unit fixing member 27 in the arrow direction w. Move the developing units 16–18 from the revolver 19 in the direction right angle to the front side of the main body 8*a* of the apparatus.

Next, the color image forming process by the image forming unit 10 will be described. In the image forming unit 10, a color image is formed by superposing yellow (Y), magenta (M) and cyan (C) images in this order. When starting the image forming operation, the developing roller 20*b* of the yellow (Y) developing unit 16 is arranged at the developing position opposite to the photosensitive drum 11.

When the image forming process starts, the photosensitive drum 11 rotates in the arrow direction s and with this rotation, the photosensitive drum 11 is uniformly charged by the charger 12 and a laser beam corresponding to a yellow image signal is applied by the laser writing unit 13. As a result, an electrostatic latent image of a yellow image is formed on the photosensitive drum 11 and when the drum reaches the developing unit 16, a yellow (Y) toner image is formed.

Then, the toner image formed on the photosensitive drum 11 reaches the contacting position with the intermediate transferring belt 21*a* that is rotated in the arrow direction u and primarily transferred electrostatically on the intermediate transferring belt 21*a*. After the primarily transfer, the photosensitive drum 11 is cleaned and residual toner is removed by the cleaner 22 and the surface charger is eliminated by the charge elimination lamp 23. Then, the magenta and cyan toner image forming processes are executed in the same manner as the yellow toner image forming process and magenta and cyan images for formed on the photosensitive drum 11. Further, the yellow (Y), magenta (M) and cyan (C) toner images are transferred intermediately on the intermediate transferring belt 21*a* from the photosensitive drum 11 and a color toner superposed with 3 color images is formed on the intermediate transferring belt 21*a*

While the revolver 19 turns in the arrow direction t, it arranges the developing units 16–18 opposite to the photosensitive drum 11 corresponding to colors of toner images to be formed on thereon. The yellow (Y), magenta (M), cyan (C) color toner images superposed on the intermediate transferring belt 21*a* are secondarily transferred en bloc on a recording paper, etc. and a color image is completed thereon.

While the image forming process is thus repeated, carriers are deteriorated when a prescribed number of sheets, for example, 50,000 A4 size sheets are printed and it becomes necessary to exchange developers in the developing units 20–22 or replace the developing units 16–18 with new products. To remove the developing units 16–18 from the revolver 19 for executing the replacing maintenance of developers or the developing units 16–18, it is first necessary to remove toner cartridges 30–32 from the revolver 19 in order to remove the toner cartridges 30–32 from the developing units 16–18, rotate the revolver in the arrow direction t Fix the revolver 19 at the replacing position of the toner cartridges 30–32, remove the locking claws 30*a*–32*a* from the hooks 16*c*–18*c*. Remove the toner cartridges 30–32 from the holders 16*a*–18*a* by sliding them in the arrow direction x shown in FIG. 4, that is, in the front side direction of the main body 8*a* of the image forming apparatus. When the toner cartridges 30–32 are removed from the holders 16*a*–18*a*, the insides of the holders 16*a*–18*a* become empty and it becomes possible to insert a hand 28 from the openings 16*b*–18*b*.

Figure 7:
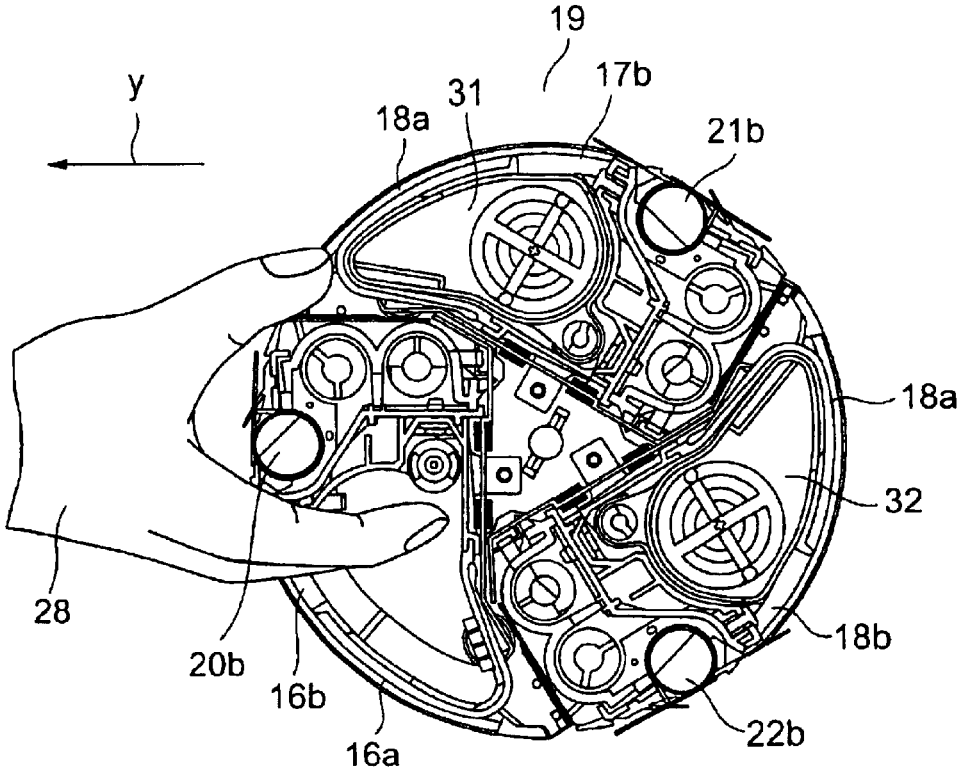
FIG. 7 is an explanatory diagram showing the state of the developing unit gripped by inserting the hand into the opening in the embodiment of the present invention.
Figure 8:
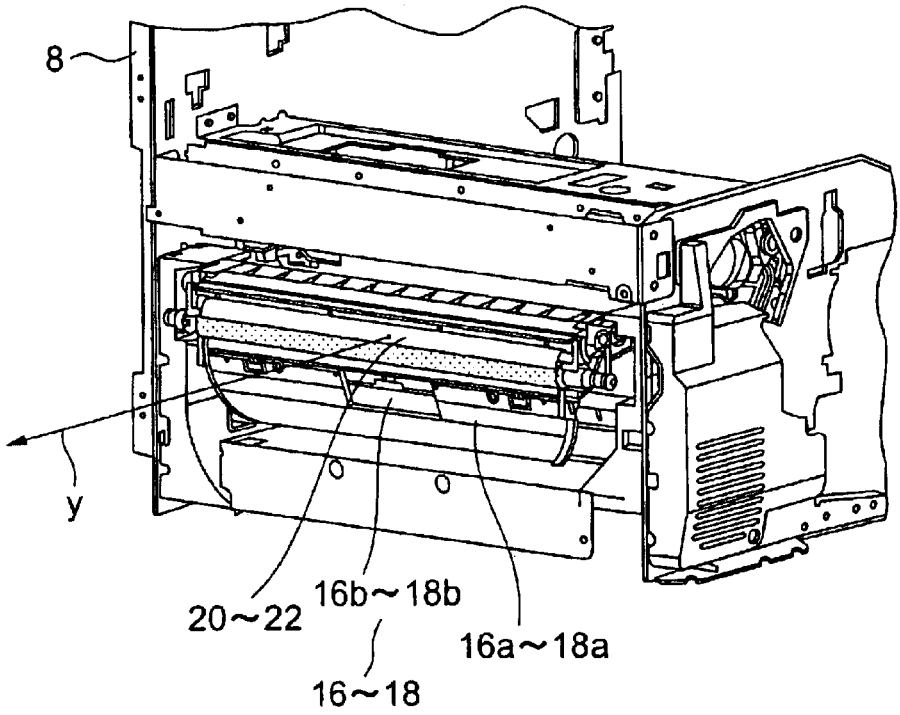
FIG. 8 is a partial perspective view showing the state of the developing unit removed from the revolver in the embodiment of the present invention.

Then, rotate the revolver 19 in the arrow direction t to the replacing position of the developing units 16–18. At the replacing position of the developing units 16–18, fix the revolver 19, remove the screw 17*a* of the developing unit fixing member 27 of the revolving holder 19*a* and open the positioning portion 26 by rotating the developing unit fixing member 27 in the arrow direction w. A serviceman should insert his hand 28 in the empty insides of the holders through the openings 16*b*–18*b* of the holders 16*a*–18*a*, grip each of the developing units 20–22 and pull out the developing units 16–18 in the arrow direction y that is the right angle to the front side of the main body 8*a* of the image forming apparatus shown in FIG. 7 and FIG. 8, and take out the developing units 16–18 from the revolver 19.

Thereafter, exchange developers in the developing units 20–22 or exchange the developing units 16–18 with new units as required and install the developing units 16–18 to the revolver 19. When installing the developing units 16–18, grip the developing units 20–22 by inserting the hand in the openings 6*b*–18*b* and install both ends of shafts 20*d*–22*d* of the developing rollers 20*b*–22*b* to the positioning portion 26.

Further, fix the developing unit fixing member 27 with the screw 27*a*. Then, rotate the revolver 19 in the arrow direction t to the replacing position of the toner cartridges 30–32, install the toner cartridges 30–32 to the holders 16*a*–18*a*, put the locking claws 30*a*–32*a* to the hooks 16*c*–18*c*. The exchange maintenance of the developing units 16–18 is now completed and the image forming process is ready to start.

According to this embodiment, when the toner cartridges 30–32 are removed from the developing units 16–18 in the exchanging maintenance of the developing units 16–18, the insides of the holders 16*a*–18*a* become empty and it becomes possible to insert the hand 28 in the empty insides through the openings 16*b*–18*b* formed on the holders 16*a*–18*a*. Accordingly, when exchanging the developing units 16–18 with new units, it is possible to remove the developing units 16–18 from the revolver 19 by gripping the developing units 20–22 firmly and moving in the right angle direction to the front side of the main body 8*a* of the image forming apparatus 8. In other words, the developing units 16–18 can be exchanged certainly and rapidly without contaminating a hand by touching the developing rollers 20*b*–22*b*, and damaging the developing units 16–18 and contaminating the periphery by dropping them accidentally and improving the maintainability and reliability.

Further, the present invention is not limited to the embodiment described above but can be modified variously within the spirit and scope of the present invention and for example, colors of developers of the developing units supported by the revolver are not limited and the number of developing units supported by the revolver can be increased to 4 units by adding a developing unit containing black toner. In addition, the structure of the image forming apparatus is optional and it is possible to obtain a full-color image by providing a developing unit containing, for example, black toner separately from the revolver around the image carrier.

As described above, according to the present invention, the openings are formed in the holding members and by removing the developer containers first from the holding members when exchanging the developing units, it becomes possible to remove a developing unit by firmly gripping the opening from the revolver. Accordingly, the operability during the exchanging maintenance of the developing units can be improved, contamination of the hand and periphery by developers and damage of the developing units by accidentally dropping them and the maintainability and reliability can be improved.

What is claimed is:

1. A developing device comprising:

plural developing units having toner cartridges containing developer, respectively, which are detachably held by hollow shaped holders for supplying developers in different colors to an image carrier; and a revolver for supporting the developing units so that they can be exchanged and capable of rotating the developing units en bloc to oppose them to the image carrier, wherein each of the holders has an opening through which a hand is inserted to grasp and pull out the developing unit from the revolver when the toner cartridge is detached from the holder so that the holder becomes empty.

2. The developing device according to claim 1, wherein the toner cartridges are detachable from the holders by moving in a direction orthogonal to the normal rotating line of the revolver, and the developing unit is removed from the revolver by moving in the normal rotating line of the revolver after removing the toner cartridges.

3. An image forming apparatus comprising:

a main body;

an image carrier provided in the main body;

a latent image forming unit to form a latent image on the image carrier;

plural developing units having toner cartridges containing developer, respectively which are detachably held by hollow shaped holders for supplying the developers in different colors to the image carrier; and a revolver provided rotatably in the main body of the image forming apparatus, for supporting the developing units, rotating the plural developing units en bloc and positioning desired developing units to face the image carrier, wherein each of the holders has an opening through which a hand is inserted to grasp and pull out the developing unit from the revolver when the respective toner cartridge is detached from the holder so that the holder becomes empty.

4. The image forming apparatus according to claim 3, wherein the toner cartridges are detached from the holders by moving in a direction of a front side of the main body of the apparatus, and the developing units are removed from the revolver by moving in a direction orthogonal to the front side of the main body after the toner cartridges are removed.

5. The image forming apparatus according to claim 4, wherein the revolver is rotated by a prescribed angle and removes the developing units from the revolver.

6. A developing device comprising:

plural developing units having toner cartridges containing developer, respectively, which are detachably held by hollow shaped holders for supplying developers in different colors to an image carrier; and a revolver that supports the developing units so that they can be exchanged is capable of rotating the developing units en bloc to oppose them to the image carrier, wherein each of the developing units can be pulled out from the revolver when the respective toner cartridge is detached from the holder so that the holder becomes empty.

7. The developing device according to claim 6, wherein each of the toner cartridges is detachable from the holders by moving the toner cartridge in a direction orthogonal to a normal rotating line of the revolver, and the developing unit is removed from the revolver by moving the developing unit in the normal rotating line of the revolver after removing the toner cartridges.

8. A developing device comprising:

plural developing units having toner cartridges containing developer, respectively, which are detachably held by hollow shaped holders for supplying developers in different colors to an image carrier, each of the toner cartridges and the holders configured so that the respective toner cartridge can be pulled out from the respective holder in a first direction; and a revolver that supports the developer units so that they can be exchanged and is capable of rotating the developing units en bloc to oppose them to the image carrier, the revolver and the developing units configured so that each developing unit can be pulled out from the revolver in a second direction that is different from the first direction.

9. The developing device according to claim 8, wherein the second direction is perpendicular to the first direction.

10. A developing device comprising:

a plurality of developing units, each of the developing units has a toner cartridge containing developer and has a holder for detachably holding the toner cartridge, the developing units supplying developers in different colors to an image carrier; and a revolver configured to support the developing units so that they can be exchanged, and configured to rotate the developer units en bloc to position them opposite to the image carrier, wherein each of the developing units is detachably attached to the revolver, and is configured for removal from the revolver when the toner cartridge has been removed from the holder.

11. The developing device according to claim 10, wherein each toner cartridge is detachable from the respective holder by moving the toner cartridge in a direction along an axis of rotation of the revolver, and each developing unit removable from the revolver by moving the developing unit in a direction normal to the axis of rotation of the revolver when the respective toner cartridge has been removed.

* * * * *